US010362637B2

(12) United States Patent
Lindley et al.

(10) Patent No.: US 10,362,637 B2
(45) **Date of Patent: *Jul. 23, 2019**

(54) INTEGRATED HEATER AND SENSOR SYSTEM

(71) Applicant: Watlow Electric Manufacturing Company, St. Louis, MO (US)

(72) Inventors: Jacob Lindley, St. Louis, MO (US); Cal Swanson, St. Louis, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/817,573

(22) Filed: Nov. 20, 2017

(65) Prior Publication Data

US 2018/0077752 A1 Mar. 15, 2018

Related U.S. Application Data

(63) Continuation of application No. 14/925,330, filed on Oct. 28, 2015, now Pat. No. 9,826,574.

(51) Int. Cl.
*H05B 1/02* (2006.01)
*H05B 3/26* (2006.01)
(Continued)

(52) U.S. Cl.
CPC ..... *H05B 1/0233* (2013.01); *H05B 1/0202* (2013.01); *H05B 3/0014* (2013.01); *H05B 3/26* (2013.01); *H05B 3/42* (2013.01); *H05B 2203/005* (2013.01); *H05B 2203/009* (2013.01); *H05B 2203/011* (2013.01);
(Continued)

(58) Field of Classification Search
CPC .. H05B 1/0233; H05B 1/0202; H05B 3/0014; H05B 3/26; H05B 3/42; H05B 2203/005; H05B 2203/009; H05B 2203/011; H05B 2203/013; H05B 2213/03; H05B 2213/07
USPC ..... 219/494, 497, 483–486; 118/725; 156/345.52
See application file for complete search history.

(56) References Cited

U.S. PATENT DOCUMENTS 6,139,627 A * 10/2000 Duval ..... C30B 11/00 117/37
6,259,072 B1 * 7/2001 Kinnard ..... H01L 21/67115 118/725
(Continued)

FOREIGN PATENT DOCUMENTS

JP 2014533431 12/2014
KR 10-0690926 2/2007
(Continued)

*Primary Examiner* — Mark H Paschall
(74) *Attorney, Agent, or Firm* — Burris Law, PLLC

(57) ABSTRACT

The present disclosure provides a thermal system that includes an array of heating resistor circuits having first termination ends and second termination ends, and a plurality of nodes connected to the heating resistor circuits at the first and second termination ends. The thermal system further includes power wires to provide power to the heating resistor circuits and signal wires to sense a temperature of each of the heating resistor circuits. Each node is connected to a power wire and to a signal wire, and a number of heating resistor circuits is greater than or equal to a number of power wires and to a number of the signal wires.

20 Claims, 8 Drawing Sheets

(51) Int. Cl.
*H05B 3/00* (2006.01)
*H05B 3/42* (2006.01)

(52) U.S. Cl.
CPC .. *H05B 2203/013* (2013.01); *H05B 2203/017* (2013.01); *H05B 2213/03* (2013.01); *H05B 2213/07* (2013.01)

(56) References Cited

U.S. PATENT DOCUMENTS

| | | | | |
|---|---|---|---|---|
| 6,353,209 | B1 * | 3/2002 | Schaper | H01L 21/67103 118/725 |
| 7,603,205 | B2 * | 10/2009 | Barry | H01L 23/3121 219/486 |
| 7,699,520 | B2 | 4/2010 | Yoo et al. | |
| 8,378,266 | B2 * | 2/2013 | Steinhauser | A47J 37/0676 219/443.1 |
| 8,996,140 | B2 * | 3/2015 | Goto | H02J 3/14 700/22 |
| 2002/0062954 | A1 * | 5/2002 | Getchel | B23Q 11/126 165/263 |
| 2003/0062359 | A1 * | 4/2003 | Ho | H01L 21/67103 219/444.1 |
| 2011/0084310 | A1 * | 4/2011 | David | B82Y 20/00 257/200 |
| 2016/0225645 | A1 * | 8/2016 | Koizumi | H01L 21/67248 |

FOREIGN PATENT DOCUMENTS

| | | |
|---|---|---|
| KR | 1020140060328 | 5/2014 |
| WO | 2013033336 | 3/2013 |

* cited by examiner

INTEGRATED HEATER AND SENSOR SYSTEM

CROSS-REFERENCE TO RELATED APPLICATIONS

This application is a continuation of U.S. patent application Ser. No. 14/925,330, filed on Oct. 28, 2015. The disclosures of the above applications are incorporated herein by reference.

FIELD

The present disclosure relates to heater systems and their related controls, and in particular, heater systems that can deliver a precise temperature profile to a heating target during operation in order to compensate for heat loss and/or other variations, in such applications as chucks or susceptors for use in semiconductor processing.

BACKGROUND

The statements in this section merely provide background information related to the present disclosure and may not constitute prior art.

In the art of semiconductor processing, for example, a chuck or susceptor is used to hold a substrate (or wafer) and to provide a uniform temperature profile to the substrate during processing. Referring to FIG. 1, a support assembly 10 for an electrostatic chuck is illustrated, which includes the electrostatic chuck 12 with an embedded electrode 14, and a heater plate or target 16 that is bonded to the electrostatic chuck 12 through an adhesive layer 18, which is typically a silicone adhesive. A heater 20 is secured to the heater plate or target 16, which may be an etched-foil heater, by way of example. This heater assembly is bonded to a cooling plate 22, again through an adhesive layer 24 that is typically a silicone adhesive. The substrate 26 is disposed on the electrostatic chuck 12, and the electrode 14 is connected to a voltage source (not shown) such that electrostatic power is generated, which holds the substrate 26 in place. A radio frequency (RF) or microwave power source (not shown) may be coupled to the electrostatic chuck 12 within a plasma reactor chamber that surrounds the support assembly 10. The heater 20 thus provides requisite heat to maintain temperature on the substrate 26 during various in-chamber plasma semiconductor processing steps, including plasma enhanced film deposition or etch.

During all phases of processing of the substrate 26, it is important that the temperature profile of the electrostatic chuck 12 be tightly controlled in order to reduce processing variations within the substrate 26 being etched, while reducing total processing time. Improved devices and methods for improving temperature uniformity on the substrate are continually desired in the art of semiconductor processing, among other applications.

SUMMARY

The present disclosure provides a thermal system comprising an array of heating resistor circuits and a plurality of nodes. Each of the heating resistor circuits have a first termination end and a second termination end, and the plurality of nodes connect to the array of heating resistor circuits at each of the first and second termination ends. The thermal system further comprises a plurality of power wires to provide power to the array of heating resistor circuits and a plurality of signal wires to sense a temperature of each of the heating resistor circuits. Each of the plurality of nodes is connected to a power wire from among the plurality of power wires and to a signal wire from among the plurality of signal wires. The number of heating resistor circuits is greater than or equal to the number of power wires and to the number of the signal wires.

In one form, the thermal system further comprises a control system coupled to the plurality of power wires and configured to provide power to at least one of the heating resistor circuits by way of the power wires. The control system may also be configured to selectively apply power or a ground signal to the plurality of nodes by way of the power wires.

In another form, the control system is coupled to the plurality of signal wires and configured to measure a resistance of each of the heating resistor circuits by way of the signal wires, and calculate the temperature of each of the heating resistor circuits based on the measured resistance.

The number of heating resistor circuits, power wires, and signal wires may vary and in one form, the number of heating resistor circuits is six, and the number of power wires and signal wires is four. In another form, the number of heating resistor circuits is three, and the number of power wires and signal wires is three.

In yet another form, the thermal system further comprises a first auxiliary signal wire connected to the heating resistor circuit at a location between the first and second termination ends of the heating resistor circuit to sense the temperature of a portion of the heating resistor circuit between the first auxiliary signal wire and the signal wires. In this form, the thermal system may further include a second auxiliary signal wire connected to the heating resistor circuit at a second location between the first and second termination ends of the heating resistor circuit to sense the temperature of a portion of the heating resistor circuit between the first auxiliary signal wire and the second auxiliary wire.

In another form, the thermal system further comprises a heater secured to a heating target and at least one tuning layer disposed proximate the heater, wherein the heater and the tuning layer includes at least one heating resistor circuit.

The present disclosure further provides a thermal system comprising an array of heating resistor circuits and a plurality of nodes. Each of the heating resistor circuits have a first termination end and a second termination end, and the plurality of nodes that connect to the array of heating resistor circuits at each of the first and second termination ends. The thermal system further comprises a plurality of power wires, a plurality of signal wires, and a control system. Each of the plurality of nodes is connected to a power wire from among the plurality of power wires and to a signal wire from among the plurality of signal wires. The control system is coupled to the plurality of power wires and the plurality of signal wires. The control system is configured to selectively supply power to the plurality of nodes by way of the power wires and to sense a temperature of the heating resistor circuits by way of the signal wires.

In one form, a number of power wires, and a number of the signal wires is equal to a number of the nodes, and the number of a heating resistor circuits is greater than or equal to the number of the nodes.

The number of heating resistor circuits, power wires, signal wires and nodes may vary and in one form, the number of heating resistor circuits is six, and the number of power wires, signal wires, and nodes is four. In another form, the number of heating resistor circuits is three, and the number of power wires, signal wires, and nodes is three.

In another form, control system is configured to determine a set point for each of the heating resistor circuits and control power to the heating resistor circuits based on the set point.

In yet another form, the control system is configured to measure a resistance of each of the heating resistor circuits by way of the signal wires, and calculate the temperature of each of the heating resistor circuits based on the measured resistance. In this form, the control system may further be configured determine a resistance set point for each of the heating resistor circuits and control the power to the heating resistor circuits based on the resistance set point.

In one form, the control system is configured to determine a time window for each of the heating resistor circuits, where the time window is a time period allotted to power the heating resistor circuit.

In another form, the thermal system further comprises a first auxiliary signal wire connected to the heating resistor circuit at a location between the first and second termination ends of the heating resistor circuit to sense the temperature of a portion of the heating resistor circuit between the first auxiliary signal wire and the signal wires.

In yet another form, the thermal system further comprises a second auxiliary signal wire connected to the heating resistor circuit at a second location between the first and second termination ends of the heating resistor circuit to sense the temperature of a portion of the heating resistor circuit between the first auxiliary signal wire and the second auxiliary wire.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 3:
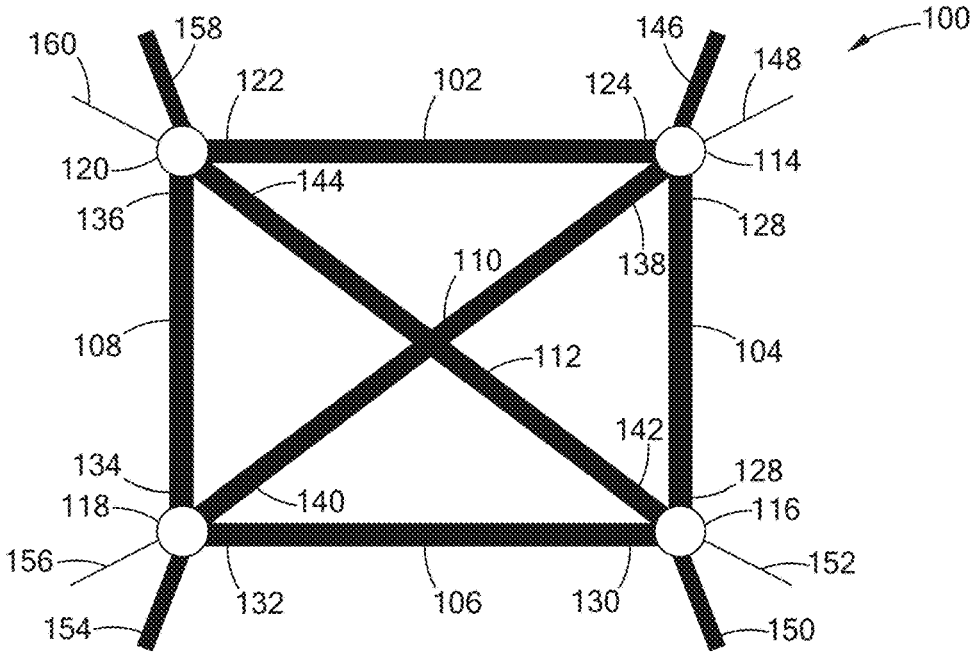
FIG. 3 is a schematic view illustrating a thermal system according to the principles of the present disclosure having four nodes.
Figure 4:
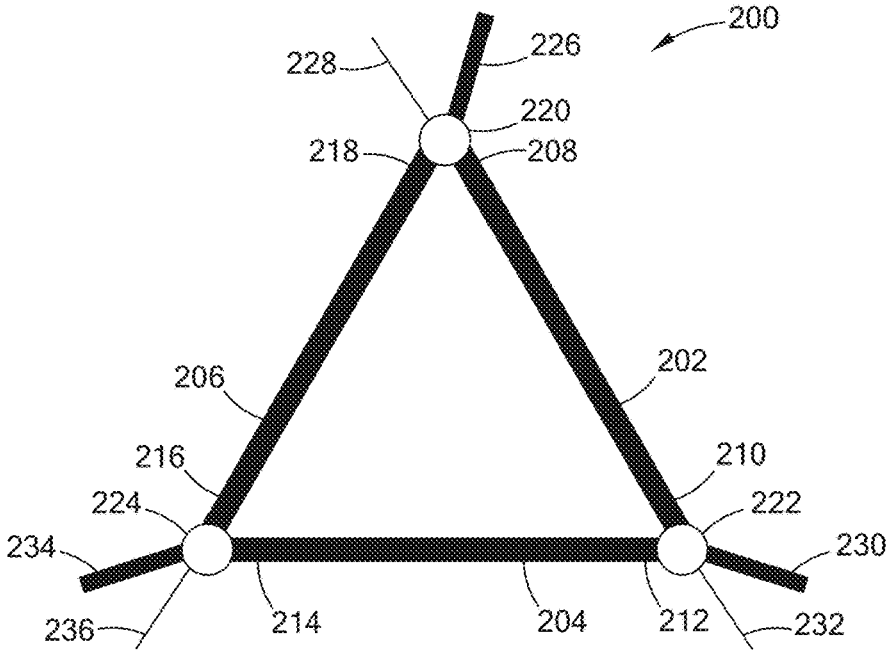
FIG. 4 is a schematic view illustrating a thermal system according to the principles of the present disclosure having three nodes.
Figure 7:
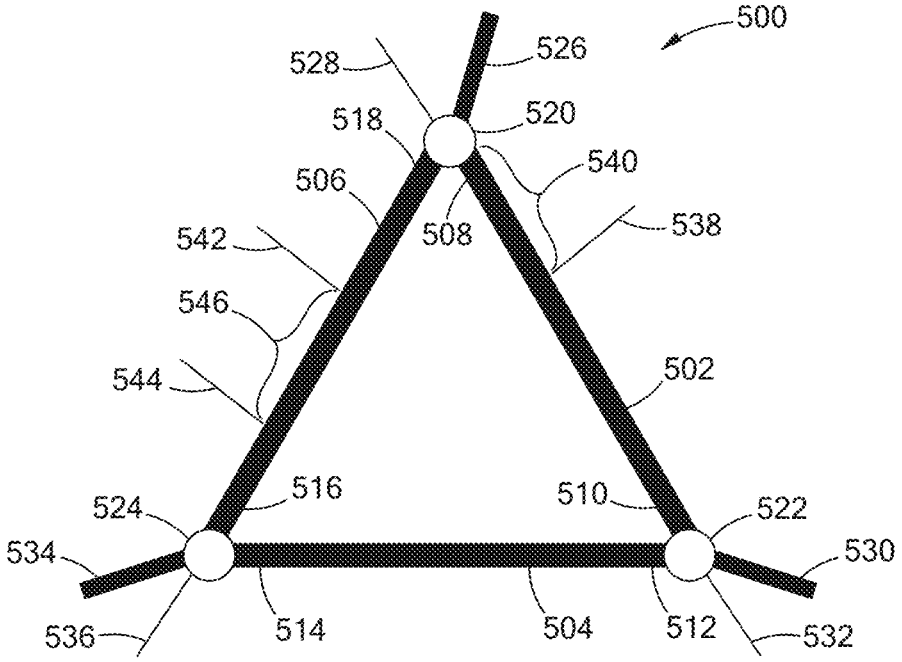
Figure 8:
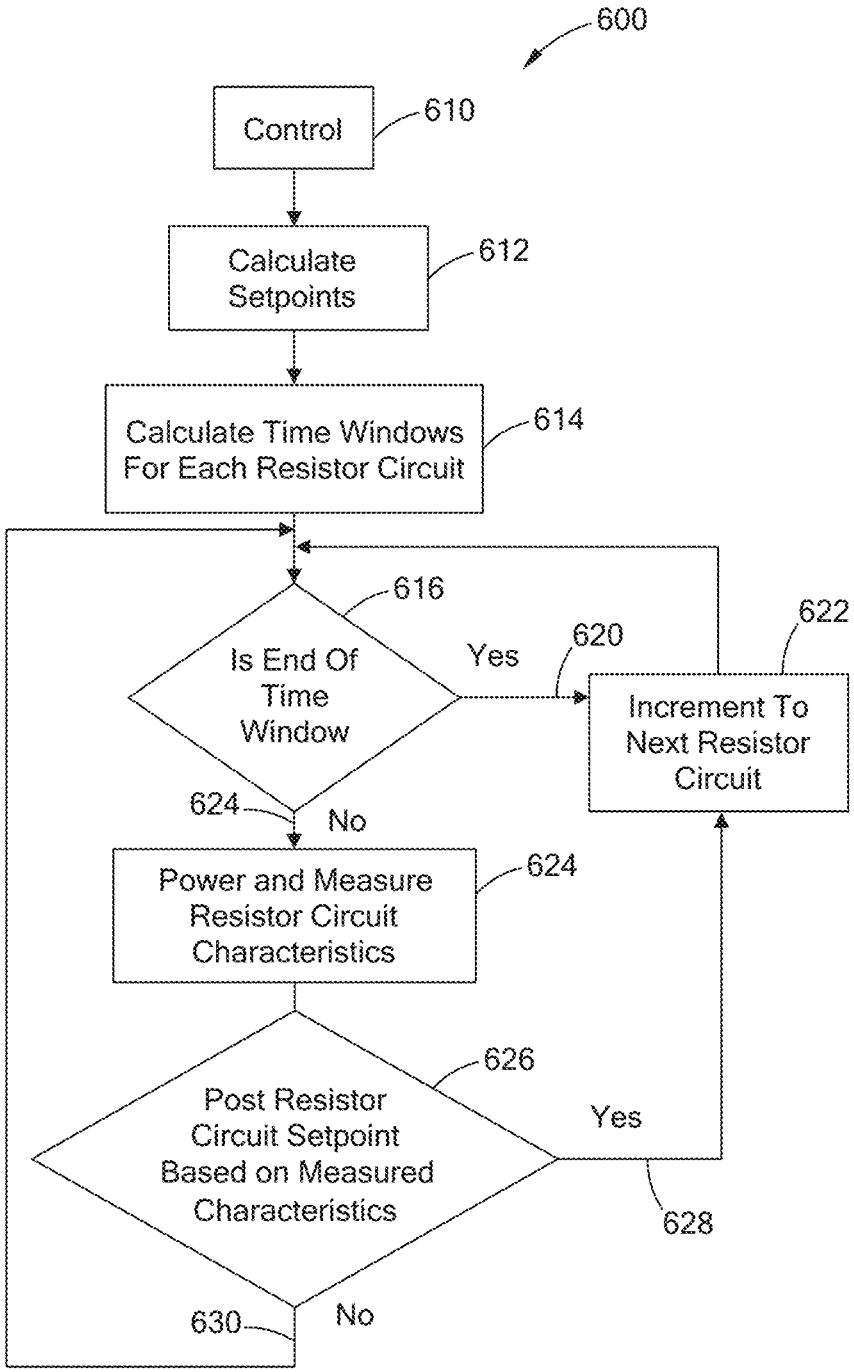
Figure 9:
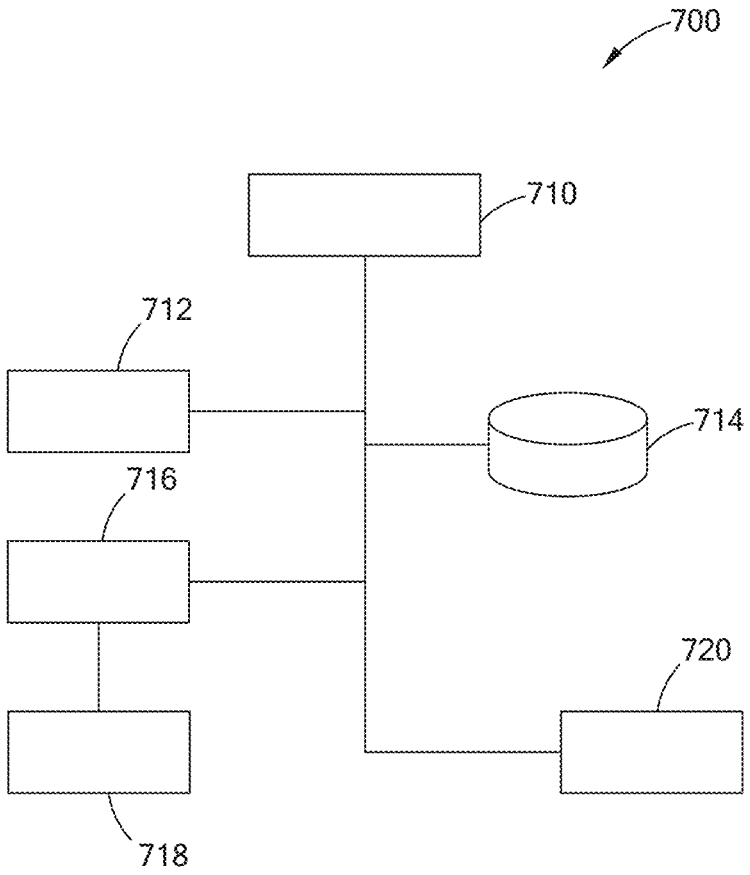

FIG. 7 is a schematic view illustrating a thermal system having three nodes and auxiliary sensing wires for sensing a temperature in one or more zones of interest in accordance with the principles of the present disclosure; and FIG. 8 is a flowchart illustrating a method of controlling a thermal array FIG. 9 is a schematic view illustrating a control system for controlling the thermal systems of FIGS. 3, 4, and 7 in accordance with the principles of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

For example, the following forms of the present disclosure are directed to chucks for use in semiconductor processing, and in some instances, electrostatic chucks. However, it should be understood that the heaters and systems provided herein may be employed in a variety of applications and are not limited to semiconductor processing applications. It should be understood that throughout the drawings, corresponding reference numerals indicate like or corresponding parts and features.

Figure 1:
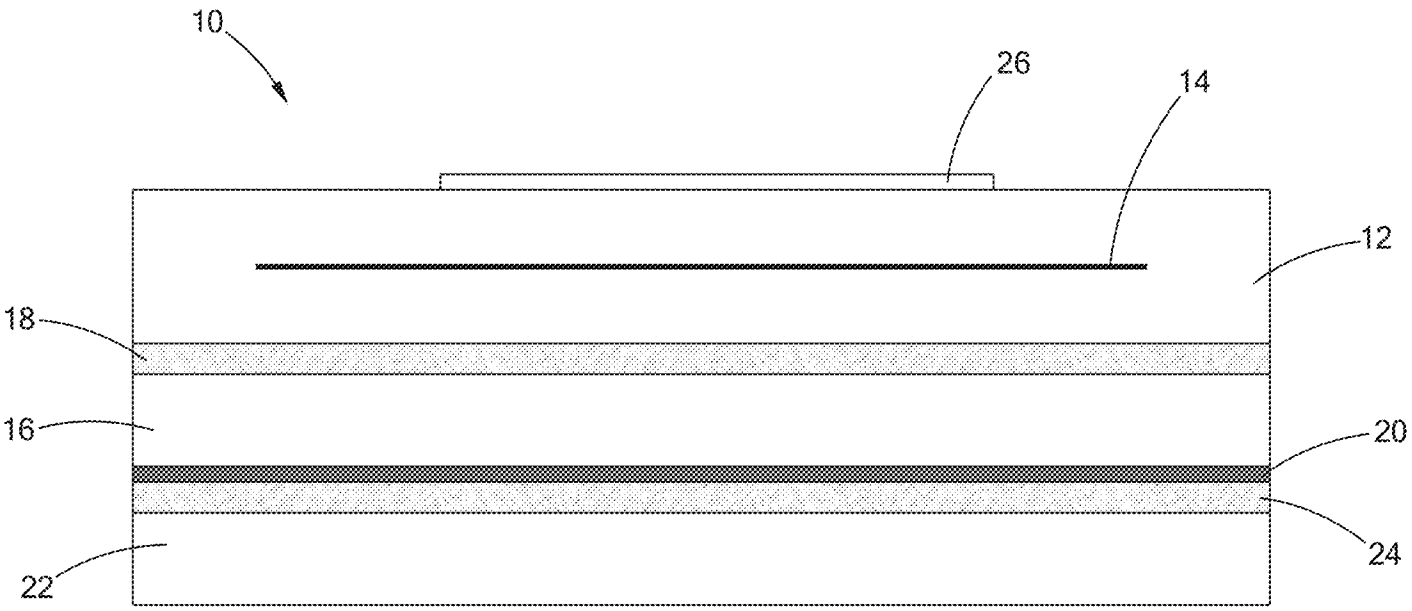
FIG. 1 (Prior Art)
FIG. 1 is an elevated side view of a prior art electrostatic chuck.
Figure 2A:
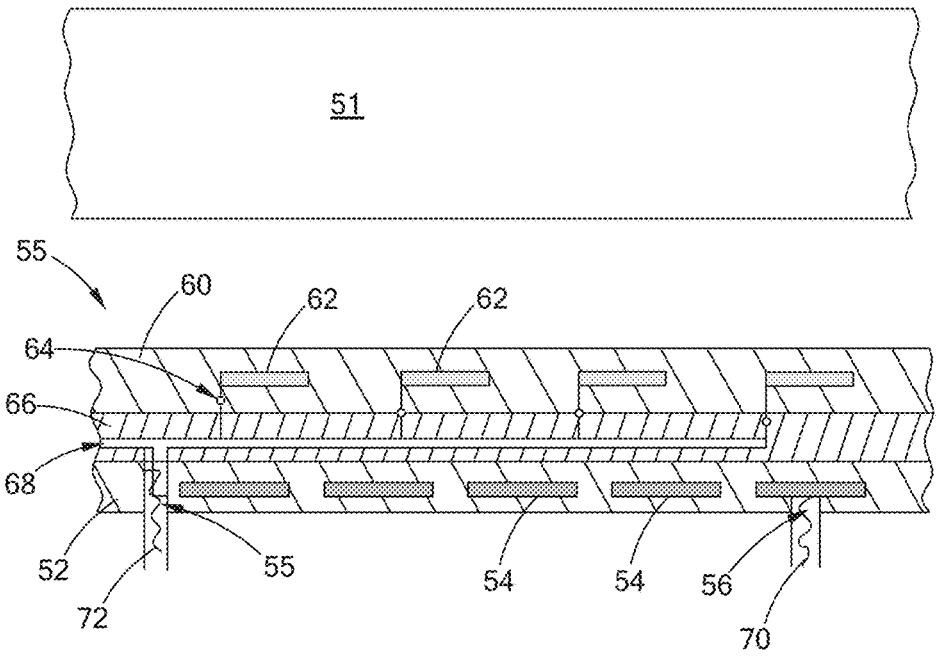
FIG. 2A is a partial side view of a heater having a tuning layer and constructed in accordance with the principles of one form of the present disclosure.

Referring to FIG. 2A, one form of the present disclosure is a heater 50 that includes a base heater layer 52 having at least one heater circuit 54 embedded therein. The base heater layer 52 has at least one aperture 56 (or via) formed there through for connecting the heater circuit 54 to a power supply (not shown). The base heater layer 52 provides primary heating while a tuning heater layer 60 disposed proximate the heater layer 52 as shown provides for fine tuning of a heat distribution provided by the heater 50. The tuning layer 60 includes a plurality of individual heating elements 62 embedded therein, which are independently controlled. At least one aperture 64 is formed through the tuning layer 60 for connecting the plurality of individual heating elements 62 to the power supply and controller (not shown). As further shown, a routing layer 66 is disposed between the base heater layer 52 and the tuning layer 60 and defines an internal cavity 68. A first set of electrical leads 70 connects the heater circuit 54 to the power supply, which extends through the heater layer aperture 56. A second set of electrical leads 72 connects a plurality of heating elements 62 to the power supply and extend through the internal cavity 68 of the routing layer 66, in addition to the aperture 55 in the base heater layer 52. It should be understood that the routing layer 66 is optional, and the heater 50 could be employed without the routing layer 66 and instead having only the base heater layer 52 and the tuning heater layer 60.

In another form, rather than providing fine tuning of a heat distribution, the tuning layer 60 may alternately be used to measure temperature in the chuck 12. This form provides for a plurality of area-specific or discreet locations, of temperature dependent resistance circuits. Each of these temperature sensors can be individually read via a multiplexing switching arrangement to allow substantially more sensors to be used relative to the number of signal wires required to measure each individual sensor, such as shown in U.S.

patent application Ser. No. 13/598,956, which is commonly assigned with the present application and the disclosures of which are incorporated herein by reference in their entirety. The temperature sensing feedback can provide necessary information for control decisions, for instance, to control a specific zone of backside cooling gas pressure to regulate heat flux from the substrate 26 to the chuck 12. This same feedback can also be used to replace or augment temperature sensors installed near the base heater 50 for temperature control of base heating zones 54 or balancing plate cooling fluid temperature (not shown) via ancillary cool fluid heat exchangers.

In one form, the base heater layer 50 and the tuning heater layer 60 are formed from enclosing heater circuit 54 and tuning layer heating elements 62 in a polyimide material for medium temperature applications, which are generally below 250° C. Further, the polyimide material may be doped with materials in order to increase thermal conductivity.

In other forms, the base heater layer 50 and/or the tuning heater layer 60 are formed by a layered process, wherein the layer is formed through application or accumulation of a material to a substrate or another layer using processes associated with thick film, thin film, thermal spraying, or sol-gel, among others.

In one form, the base heating circuit 54 is formed from Inconel® and the tuning layer heating elements 62 are a Nickel material. In still another form, the tuning layer heating elements 62 are formed of a material having sufficient temperature coefficient of resistance such that the elements function as both heaters and temperature sensors, commonly referred to as "two-wire control." Such heaters and their materials are disclosed in U.S. Pat. Nos. 7,196,295 and 8,378,266, which are commonly assigned with the present application and the disclosures of which are incorporated herein by reference in their entirety.

With the two-wire control, various forms of the present disclosure include temperature, power, and/or thermal impedance based control over the layer heating elements 62 through knowledge or measurement of voltage and/or current applied to each of the individual elements in the thermal impedance tuning layer 60, converted to electrical power and resistance through multiplication and division, corresponding in the first instance, identically to the heat flux output from each of these elements and in the second, a known relationship to the element temperature. Together these can be used to calculate and monitor the thermal impedance load on each element to allow an operator or control system to detect and compensate for area-specific thermal changes that may result from, but are not limited to, physical changes in the chamber or chuck due to use or maintenance, processing errors, and equipment degradation. Alternatively, each of the individually controlled heating elements in the thermal impedance tuning layer 60 can be assigned a setpoint resistance corresponding to the same or different specific temperatures which then modify or gate the heat flux originating from corresponding areas on a substrate through to the base heater layer 52 to control the substrate temperature during semiconductor processing.

In one form, the base heater 50 is bonded to a chuck 51, for example, by using a silicone adhesive or even a pressure sensitive adhesive. Therefore, the heater layer 52 provides primary heating, and the tuning layer 60 fine tunes, or adjusts, the heating profile such that a uniform or desired temperature profile is provided to the chuck 51, and thus the substrate (not shown).

In another form of the present disclosure, the coefficient of thermal expansion (CTE) of the tuning layer heating elements 62 is matched to the CTE of the tuning heating layer substrate 60 in order to improve thermal sensitivity of the tuning layer heating elements 62 when exposed to strain loads. Many suitable materials for two-wire control exhibit similar characteristics to Resistor Temperature Devices (RTDs), including resistance sensitivity to both temperature and strain. Matching the CTE of the tuning layer heating elements 62 to the tuning heater layer substrate 60 reduces strain on the actual heating element. And as the operating temperatures increase, strain levels tend to increase, and thus CTE matching becomes more of a factor. In one form, the tuning layer heating elements 62 are a high purity Nickel-Iron alloy having a CTE of approximately 15 ppm/° C., and the polyimide material that encloses it has a CTE of approximately 16 ppm/° C. In this form, materials that bond the tuning heater layer 60 to the other layers exhibit elastic characteristics that physically decouple the tuning heater layer 60 from other members of the chuck 12. It should be understood that other materials with comparable CTEs may also be employed while remaining within the scope of the present disclosure.

Figure 2B:
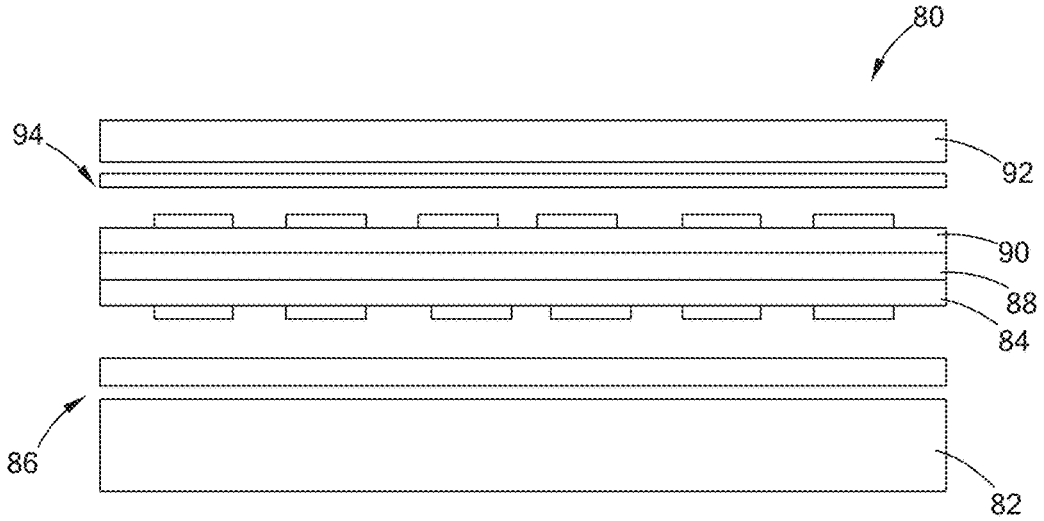
FIG. 2B is an exploded side view of another form of the heater having a tuning layer or tuning heater and constructed in accordance with the principles of the present disclosure.
Figure 2C:
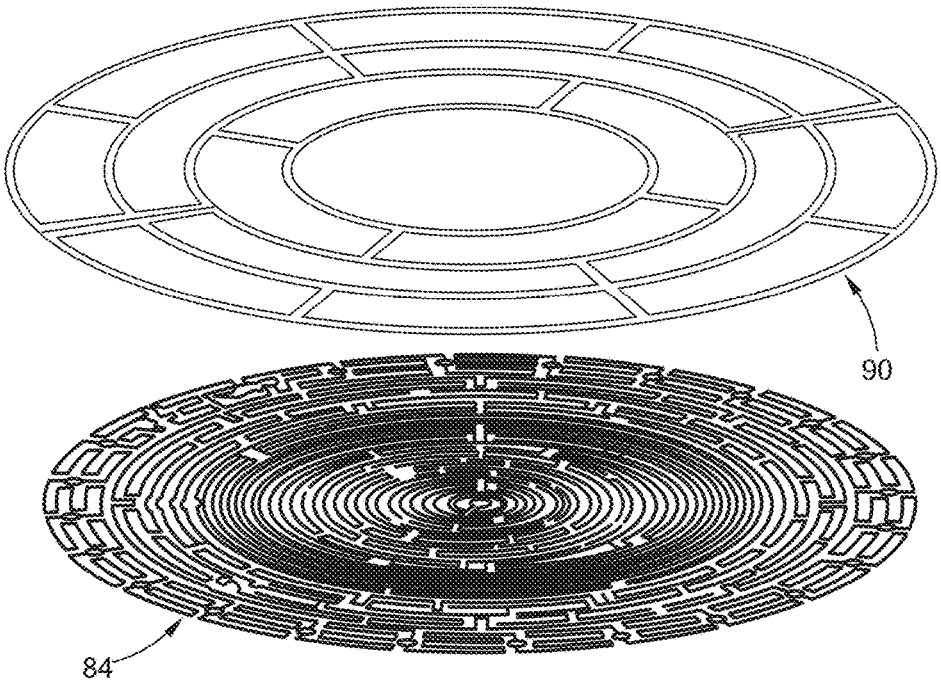
FIG. 2C is a perspective exploded view of a heater illustrating an exemplary four (4) zones for the base heater and eighteen (18) zones for the tuning heater in accordance with the principles of the present disclosure.
Figure 2D:
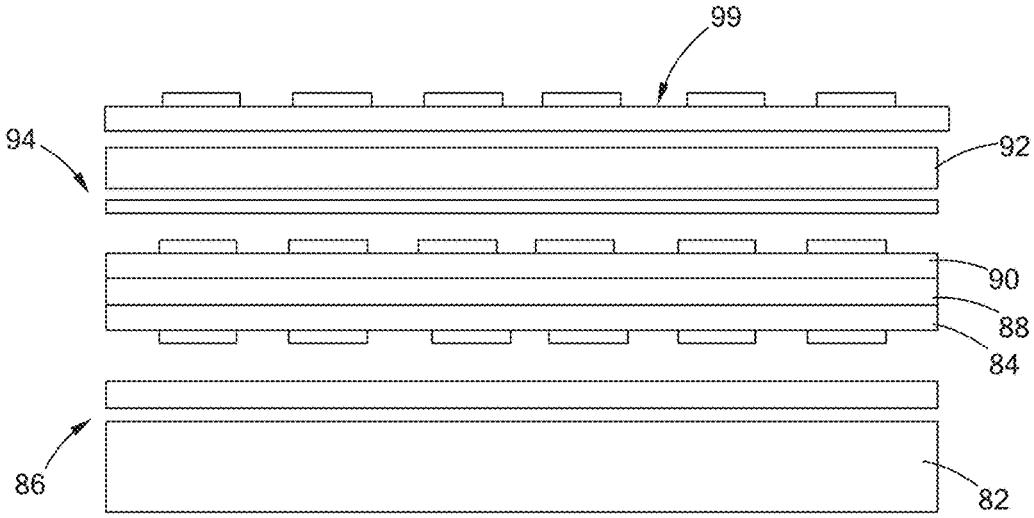
FIG. 2D is a side view of another form of a high definition heater system having a supplemental tuning layer and constructed in accordance with the principles of the present disclosure.

Referring now to FIGS. 2B-2D, one exemplary form of the heater having both a base heater layer and a tuning layer (as generally set forth above in FIG. 2A) is illustrated and generally indicated by reference numeral 80. The heater 80 includes a base plate or target 82, (also referred to as a cooling plate), which in one form is an Aluminum plate approximately 16 mm in thickness. A base heater 84 is secured to the base plate or target 82, in one form using an elastomeric bond layer 86 as shown. The elastomeric bond may be one disclosed in U.S. Pat. No. 6,073,577, which is incorporated herein by reference in its entirety. A substrate 88 is disposed on top of the base heater 84 and is an Aluminum material approximately 1 mm in thickness according to one form of the present disclosure. The substrate 88 is designed to have a thermal conductivity to dissipate a requisite amount of power from the base heater 84. Because the base heater 84 has relatively high power, without a requisite amount of thermal conductivity, this base heater 84 would leave "witness" marks (from the resistive circuit trace) on adjacent components, thereby reducing the performance of the overall heater system.

A tuning heater 90 is disposed on top of the substrate 88 and is secured to a chuck 92 using an elastomeric bond layer 94, as set forth above. The chuck 92 in one form is an Aluminum Oxide material having a thickness of approximately 2.5 mm. It should be understood that the materials and dimensions as set forth herein are merely exemplary and thus the present disclosure is not limited to the specific forms as set forth herein. Additionally, the tuning heater 90 has lower power than the base heater 84, and as set forth above, the substrate 88 functions to dissipate power from the base heater 84 such that "witness" marks do not form on the tuning heater 90.

The base heater 84 and the tuning heater 90 are shown in greater detail in FIG. 2C in which an exemplary four (4) zones are shown for the base heater 84, and eighteen (18) zones for the tuning heater 90. In one form, the heater 80 is adapted for use with chuck sizes of 450 mm, however, the heater 80 may be employed with larger or smaller chuck sizes due to its ability to highly tailor the heat distribution. Additionally, the high definition heater 80 may be employed around a periphery of the chuck, or in predetermined locations across the chuck, rather than in a stacked/planar configuration as illustrated herein. Further still, the high definition heater 80 may be employed in process kits, chamber walls, lids, gas lines, and showerheads, among other components within semiconductor processing equipment. It should also be understood that the heaters and control systems illustrated and described herein may be employed in any number of applications, and thus the exemplary semiconductor heater chuck application should not be construed as limiting the scope of the present disclosure.

The present disclosure also contemplates that the base heater 84 and the tuning heater 90 not be limited to a heating function. It should be understood that one or more of these members, referred to as a "base functional layer" and a "tuning layer," respectively, may alternately be a temperature sensor layer or other functional member while remaining within the scope of the present disclosure.

As shown in FIG. 2D a dual tuning capability may be provided with the inclusion of a secondary tuning layer heater 99 on the top surface of the chuck 12. The secondary tuning layer may alternately be used as a temperature sensing layer rather than a heating layer while remaining within the scope of the present disclosure. Accordingly, any number of tuning layer heaters may be employed and should not be limited to those illustrated and described herein. It should also be understood that the thermal array as set forth in the following may be employed with a single heater or multiple heaters, whether layered or in other configurations, while remaining within the scope of the present disclosure.

Referring to FIG. 3, a thermal system 100 for use in a thermal array system, such as those described in FIGS. 2A-2D is shown. The thermal system 100 includes six resistor circuits 102, 104, 106, 108, 110, and 112. In addition, the thermal system 100 includes four nodes 114, 116, 118, and 120. Each of the resistor circuits 102, 104, 106, 110, and 112 may have a resistive heating element. The resistive heating element may be selected from the group consisting of a layered heating element, an etched foil element, or a wire wound element.

Each of the six resistor circuits 102, 104, 106, 108, 110, and 112, have two termination ends at opposite ends of each of the resistor circuits 102, 104, 106, 108, 110, and 112. More specifically, resistor circuit 102 has termination ends 122 and 124. Resistor circuit 104 has termination ends 126 and 128. Resistor circuit 106 has termination ends 130 and 132. Resistor circuit 108 has termination ends 134 and 136. Resistor circuit 110 has termination ends 138 and 140. Finally, resistor circuit 112 as termination ends 142 and 144.

In this example, termination end 124 of resistor circuit 102, termination end 138 of resistor circuit 110, and termination end 128 of resistor circuit 104 are connected to node 114. Termination end 122 of resistor circuit 102, termination end 144 of resistor circuit 112, and termination end 136 of resistor circuit 108 are connected to node 122. Termination end 132 of resistor circuit 106, termination end 140 of resistor circuit 110, and termination end 134 of resistor circuit 108 are connected to node 118. Finally, termination end 122 of resistor circuit 102, termination end 144 of resistor circuit 112, and termination end 136 of resistor circuit 108 are connected to node 120.

Each of the nodes 114, 116, 118, and 120, have two wires protruding therefrom. One of the wires is a power wire that provides a voltage to the node, while the other wire is a signal wire for receiving a signal indicative of the resistance across the resistor circuits 102, 104, 106, 108, 110, and 112. The resistance across the circuits 102, 104, 106, 108, 110, and 112, can be used to determine the temperature of each of the resistor circuits. The signal wires may be made of a platinum material.

Here, node 114 has a power wire 146 and a signal wire 148 protruding therefrom. Node 116 has a power wire 150 and a signal wire 152 protruding therefrom. Node 118 has a power wire 154 in a signal wire 156 protruding therefrom. Finally, node 126 has a power wire 158 and a signal wire 160 protruding therefrom. All of these wires may be connected to a control system which will be described later in this description.

By selectively providing either a power or ground signal to the power wires 146, 150, 154, and 158, a current can be transmitted through each of the resistor circuits 102, 104, 106, 108, 110, and 112, thereby creating heat when the current passes through the resistor circuits 102, 104, 106, 108, 110, and 112.

The table below illustrates each combination of power or ground signal provided to the power lines 146, 150, 154, and 158 of nodes 114, 116, 118, and 120, respectively. As shown in the table, there flexibility with controlling which heating circuits provides heating the thermal array system.

| Node 120 | Node 118 | Node 116 | Node 114 | Heating Circuits |
|---|---|---|---|---|
| GND | GND | GND | GND | None |
| GND | GND | GND | PWR | 102, 104, 110 |
| GND | GND | PWR | GND | 104, 106, 112 |
| GND | GND | PWR | PWR | 102, 106, 110, 112 |
| GND | PWR | GND | GND | 106, 108, 110 |
| GND | PWR | GND | PWR | 102, 104, 106, 108 |
| GND | PWR | PWR | GND | 104, 108, 110, 112 |
| GND | PWR | PWR | PWR | 102, 108, 112 |
| PWR | GND | GND | GND | 102, 108, 112 |
| PWR | GND | GND | PWR | 104, 108, 110, 112 |
| PWR | GND | PWR | GND | 102, 104, 106, 108 |
| PWR | GND | PWR | PWR | 106, 108, 110 |
| PWR | PWR | GND | GND | 102, 106, 110, 112 |
| PWR | PWR | GND | PWR | 104, 106, 112 |
| PWR | PWR | PWR | GND | 102, 104, 110 |
| PWR | PWR | PWR | PWR | None |

Referring to FIG. 4, another example of the thermal system 200 is shown. Thermal system 200 includes resistor circuits 202, 204, and 206. Like before, each of the resistor circuits have two termination ends located at either end of the resistor circuits. More specifically, resistor circuit 202 has termination ends 208 and 210, resistor circuit 204 has termination ends 212 and 214, while resistor circuit 206 has termination ends 216 and 218.

The system 200 includes nodes 220, 222, and 224. Connected to node 220 are termination ends 208 and 218 of resistor circuits 202 and 206, respectively. Connected to node 222 are termination ends 210 and 212 of resistor circuits 202 and 204, respectively. Finally, connected to node 224 are termination ends 214 and 216 of resistor circuits 204 and 206, respectively. Like the example described in FIG. 3, each of the nodes 220, 222, and 224 have two wires protruding therefrom, which may be connected to a control system. More specifically, node 220 has a power wire 226 and a signal wire 228 protruding therefrom. Node 222 has a power wire 230 and a signal wire 232 protruding therefrom. Finally, node 224 has a power wire 234 and a signal wire 236 protruding therefrom.

As such, a control system can provide a power or ground signal to each of the power wires 226, 230, and 234 in a selective manner. Similarly, the control system could measure the resistance between any of the resistor circuits 202, 204, and/or 206, by selectively measuring the resistance between the nodes 220, 222, and 224 by using signal wires 228, 232, 236. As stated before, measuring the resistance across the resistor circuits 202, 204, and 206 is useful in determining the temperature of the resistor circuits 202, 204, and/or 206.

The table below illustrates each combination of power or ground signal provided to the power lines 226, 230, 234 to nodes 220, 222, 224, respectively. As shown in the table, there flexibility with controlling which heating circuits provides heating the thermal array system.

| Node 224 | Node 222 | Node 220 | Heating Circuits |
|---|---|---|---|
| GND | GND | GND | None |
| GND | GND | PWR | 202, 206 |
| GND | PWR | GND | 202, 204 |
| GND | PWR | PWR | 204, 206 |
| PWR | GND | GND | 204, 206 |
| PWR | GND | PWR | 202, 204 |
| PWR | PWR | GND | 202, 206 |
| PWR | PWR | PWR | None |

It should be understood that any one of a number of different combinations of nodes and resistor circuits could be utilized. As stated before, the examples given in FIGS. 3 and 4 are just two types of examples and there can be any one of a number of different configurations that involve anyone of a number of different nodes and/or resistor circuits.

Generally, the plurality of resistor circuits defines a number of resistor circuits $R_n$. The plurality of nodes defining a number of nodes $N_n$. The plurality of power wires are connected to each of the plurality of nodes to provide power to the plurality of resistor circuits, wherein the plurality of power wires defining a number of power wires $P_n$. A plurality of signal wires connects to each of the plurality of nodes to sense the temperature of each of the plurality of resistor circuits. The plurality of signal wires defining a number of signal wires S. The number of power wires $P_n$ and the number of signal wires $S_n$ is equal to the number of nodes $N_n$, and the number of resistor circuits $R_n$ is greater than or equal to the number of nodes $N_n$.

Figure 5:
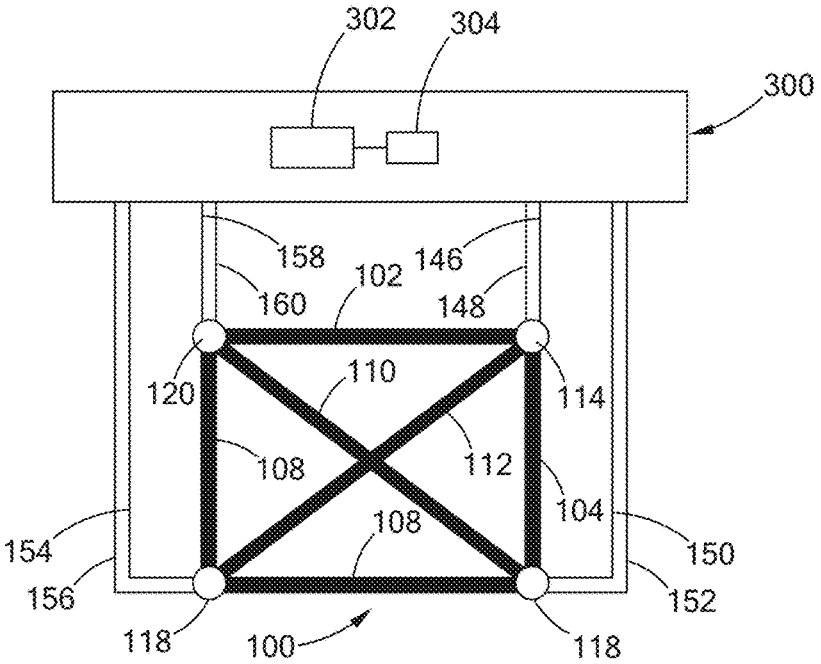
FIG. 5 is a schematic view illustrating the thermal system of FIG. 2 connected to a control system in accordance with the principles of the present disclosure.

Referring to FIG. 5, the thermal system 100 of FIG. 3 is shown coupled to a control system 300. More specifically, the control system 300 has a processor 302 that is in communication with a memory 304. The memory 304 may contain instructions that configure the processor 302 to perform any one of a number of different functions.

These functions may include providing power to the power lines 146, 150, 154, and/or 158 of the thermal system 100 or taking measurements of the signal lines 148, 152, 156, and/or 160. The control system may also include a sensing element connected to the signal wires, wherein the sensing element is a thermocouple or a resistance temperature detector.

In this example, the power lines 146, 150, 154, and 158 as well as the signal lines 148, 152, 156, and 160 are directly connected to the control system 300 and therefore are in communication the processor 302 of the control system 300 for receiving power or measuring signals. Of course, it should be understood that the instructions configuring the processor 302 may be stored within the processor or at a remote storage location and not necessarily the memory 304.

Figure 6:
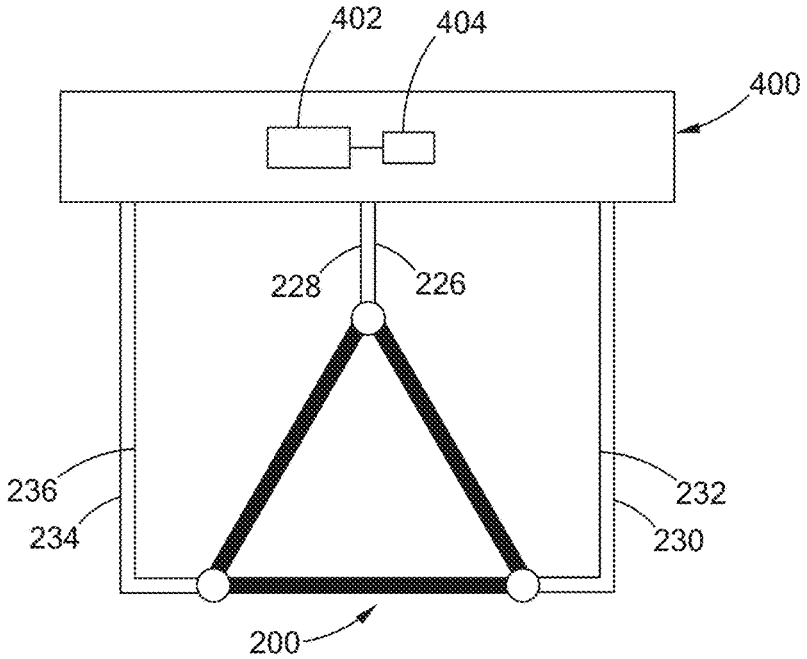
FIG. 6 is a schematic view illustrating the thermal system of FIG. 3 connected to a control system in accordance with the principles of the present disclosure.

Referring to FIG. 6, the thermal system 200 of FIG. 4 is shown connected to a control system 400. Like the control system 300, the control system 400 includes a processor 402 as well as a memory 404 in communication with the processor 402. The memory 404 may contain instructions for configuring the processor perform any one of a number of different functions including providing power to the power lines to 26, 230, and 234 of the thermal system 200. Additionally, the instructions may configure the processor to perform measurements across the signal wires 228, 232, and 236 of the thermal system 200. Of course, it should be understood that the instructions configuring the processor 402 may be stored within the processor or at a remote storage location and not necessarily the memory 404.

Referring to FIG. 7, another example of the thermal system 500 is shown. Here, the thermal system 500 is similar to the thermal system 200 of FIG. 4. However, thermal system 500 includes additional auxiliary signal wires that will be described in the paragraphs that follow. Like a thermal system 200, thermal system 500 includes resistor circuits 502, 504, and 506. Like before, each of the resistor circuits have two termination ends located at either end of the resistor circuits. More specifically, resistor circuit 502 has termination ends 508 and 510, resistor circuit 504 has termination ends 512 and 514, while resistor circuit 506 has termination ends 516 and 518.

The system 500 includes nodes 520, 522, and 524. Connected to node 520 are termination ends 508 and 518 of resistor circuits 502 and 506, respectively. Connected to node 522 are termination ends 510 and 512 of resistor circuits 502 and 504, respectively. Finally, connected to node 524 are termination ends 514 and 516 of resistor circuits 504 and 506, respectively. Like the embodiment described in FIG. 4, each of the nodes 520, 522, and 524 have two wires protruding therefrom. More specifically, node 520 has a power wire 526 and a signal wire 528 protruding therefrom. Node 522 has a power wire 530 and a signal wire 532 protruding therefrom. Finally, node 524 has a power wire 534 and a signal wire 536 protruding therefrom.

As such, a control system can provide a power or ground signal to each of the power wires 526, 530, and 534 in a selective manner, as shown in the table above for system 200. Similarly, the control system could measure the resistance between any of the resistor circuits 502, 504, and/or 506, by selectively measuring the resistance between the nodes 520, 522, and 524 by using signal wires 528, 532, 536. As stated before, measuring the resistance across the resistor circuits 502, 504, and 506 is useful in determining the temperature of the resistor circuits 502, 504, and/or 506.

However, system 500 may also include and auxiliary signal wire 538 connected to resistor circuit 502. The auxiliary signal wire 538 can be connected to the control system described in this specification and would allow for measurements of resistance, and therefore temperature, in a zone of interest 540. Additionally, or alternatively, one or more auxiliary signal wires may be connected to any of the resistor circuits so as to monitor the temperature in any one of a number of different zones of interest. For example, system 500 may also include auxiliary signal wires 542 in 544 connected to resistor circuit 506. These auxiliary signal wires 542 and 544 may be connected to a control system, which allows the measurement of temperature in a zone of interest 546, which is between the nodes 520 and 524.

As such, any one of a number of different auxiliary wires may be connected to the resistor circuits to allow monitoring of the temperature of multiple zones of interest. Further, the use of one or more auxiliary wires may be used in any example described herein, such as the example shown in FIG. 3.

Now referring to FIG. 8, a method 600 is provided for controlling the thermal system. The method 600 can be utilized controlling any of the thermal array systems described and can be executed by any of the control systems described. The method starts at block 610. In block 612 the controller calculates the set points for each resistor circuit of the array. For example, resistance set points may be set for each resistor circuit such that a measured resistance for that resistor circuit can be used as a trigger to stop providing power to that resistor circuit. In block 614, the time window for each resistor circuit is calculated. The time window may be the time allotted to power a particular resistor circuit. Although, if the resistor circuit resistance is above the set point, the controller may remain dormant for the remainder of the time window or may directly move to the next window to power the next resistor circuit. However, it may be desirable to have a minimum wait time for each resistor circuit such that power is not constantly provided to the system for measurement purposes, thereby heating elements beyond what is necessary for the heating application.

In block 616, the controller determines if the end of the time window has been reached for the current resistor circuit. If the end of the time window had been reached for the current resistor circuit, the method follows line 620 to block 622. In block 622, the controller increments to the next resistor circuit within the array and proceeds to block 616 where the process continues. If the end of the time window has not been reached the method follows line 618 to block 624. In block 624, the controller may simultaneously provide power to the resistor circuit and measure electrical characteristics of the resistor circuit. In block 626, the controller determines if the resistor circuit has exceeded the resistor circuit set point based on the measured characteristics. If the set point has been exceeded, the method may wait until the timing window is complete or, after some delay, proceed along the line 628 to block 622. In block 622, the resistor circuit is incremented to the next resistor circuit and the process proceeds to block 616. If the resistor circuit has not exceeded the set point based on the measured characteristics, the process follows line 630 block 616 where the process continues.

Any of the controllers, control systems, or engines described may be implemented in one or more computer systems. One exemplary system is provided in FIG. 9. The computer system 700 includes a processor 710 for executing instructions such as those described in the methods discussed above. The instructions may be stored in a computer readable medium such as memory 712 or storage devices 714, for example a disk drive, CD, or DVD. The computer may include a display controller 716 responsive to instructions to generate a textual or graphical display on a display device 718, for example a computer monitor. In addition, the processor 710 may communicate with a network controller 720 to communicate data or instructions to other systems, for example other general computer systems. The network controller 720 may communicate over Ethernet or other known protocols to distribute processing or provide remote access to information over a variety of network topologies, including local area networks, wide area networks, the Internet, or other commonly used network topologies.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

What is claimed is:

1. A thermal system comprising:

an array of heating resistor circuits, each of the heating resistor circuits having a first termination end and a second termination end;

a plurality of nodes that connect to the array of heating resistor circuits at each of the first and second termination ends;

a plurality of power wires to provide power to the array of heating resistor circuits; and a plurality of signal wires to sense a temperature of each of the heating resistor circuits, wherein each of the plurality of nodes is connected to a power wire from among the plurality of power wires and to a signal wire from among the plurality of signal wires, and wherein a number of heating resistor circuits is greater than or equal to a number of power wires and to a number of the signal wires.

2. The thermal system of claim 1 further comprising a control system coupled to the plurality of power wires and configured to provide power to at least one of the heating resistor circuits by way of the power wires.

3. The thermal system of claim 2, wherein the control system is configured to selectively apply power or a ground signal to the plurality of nodes by way of the power wires.

4. The thermal system of claim 2, wherein the control system is coupled to the plurality of signal wires and configured to measure a resistance of each of the heating resistor circuits by way of the signal wires, and calculate the temperature of each of the heating resistor circuits based on the measured resistance.

5. The thermal system of claim 1, wherein the number of heating resistor circuits is six, and the number of power wires and signal wires is four.

6. The thermal system of claim 1, wherein the number of heating resistor circuits is three, and the number of power wires and signal wires is three.

7. The thermal system of claim 1 further comprising a first auxiliary signal wire connected to the heating resistor circuit at a location between the first and second termination ends of the heating resistor circuit to sense the temperature of a portion of the heating resistor circuit between the first auxiliary signal wire and the signal wires.

8. The thermal system of claim 7 further comprising a second auxiliary signal wire connected to the heating resistor circuit at a second location between the first and second termination ends of the heating resistor circuit to sense the temperature of a portion of the heating resistor circuit between the first auxiliary signal wire and the second auxiliary wire.

9. The thermal system of claim 1 further comprising:

a heater secured to a heating target; and at least one tuning layer disposed proximate the heater, wherein the heater and the at least one tuning layer includes at least one heating resistor circuit of the plurality of heating resistor circuits.

10. A thermal system comprising:

an array of heating resistor circuits, each of the heating resistor circuits having a first termination end and a second termination end;

a plurality of nodes that connect to the array of heating resistor circuits at each of the first and second termination ends;

a plurality of power wires to provide power to the array of heating resistor circuits, wherein each of the plurality of nodes is connected to a power wire from among the plurality of power wires;

a plurality of signal wires to sense a temperature of the array of heater resistor circuits, wherein each of the plurality of nodes is connected to a signal wire from among the plurality of signal wires; and a control system coupled to the plurality of power wires and the plurality of signal wires, wherein the control system is configured to selectively supply power to the plurality of nodes by way of the power wires and to sense a temperature of the heating resistor circuits by way of the signal wires.

11. The thermal system of claim 10, wherein a number of the power wires and a number of the signal wires is equal to a number of the nodes, and the number of the heating resistor circuits is greater than or equal to the number of the nodes.

12. The thermal system of claim 11, wherein the number of heating resistor circuits is six, and the number of power wires, signal wires, and nodes is four.

13. The thermal system of claim 11, wherein the number of heating resistor circuits is three, and the number of power wires, signal wires, and nodes is three.

14. The thermal system of claim 10, wherein the control system is configured to determine a set point for each of the heating resistor circuits and control power to the heating resistor circuits based on the set point.

15. The thermal system of claim 10, wherein the control system is configured to measure a resistance of each of the heating resistor circuits by way of the signal wires, and calculate the temperature of each of the heating resistor circuits based on the measured resistance.

16. The thermal system of claim 15, wherein the control system is configured to determine a resistance set point for each of the heating resistor circuits and control the power to the heating resistor circuits based on the resistance set point.

17. The thermal system of claim 10, wherein the control system is configured to determine a time window for each of the heating resistor circuits, wherein the time window is a time period allotted to power the heating resistor circuit.

18. The thermal system of claim 10 further comprising a first auxiliary signal wire connected to the heating resistor circuit at a location between the first and second termination ends of the heating resistor circuit to sense the temperature of a portion of the heating resistor circuit between the first auxiliary signal wire and the signal wires.

19. The thermal system of claim 18 further comprising a second auxiliary signal wire connected to the heating resistor circuit at a second location between the first and second termination ends of the heating resistor circuit to sense the temperature of a portion of the heating resistor circuit between the first auxiliary signal wire and the second auxiliary wire.

20. The thermal system of claim 10 further comprising:

a heater secured to a heating target; and at least one tuning layer disposed proximate the heater, wherein the heater and the at least one tuning layer includes at least one heating resistor circuit of the plurality of heating resistor circuits.

* * * * *